US008882878B2

(12) United States Patent
Igarashi et al.

(10) Patent No.: US 8,882,878 B2
(45) Date of Patent: Nov. 11, 2014

(54) METHOD OF PRODUCING ULTRA-FINE METAL PARTICLES

(75) Inventors: Hiroshi Igarashi, Kai (JP); Takayuki Matsumura, Kai (JP); Shinichi Miyake, Kai (JP)

(73) Assignee: Taiyo Nippon Sanso Corporation, Tokyo (JP)

( * ) Notice: Subject to any disclaimer, the term of this patent is extended or adjusted under 35 U.S.C. 154(b) by 423 days.

(21) Appl. No.: 12/670,266

(22) PCT Filed: Jul. 8, 2008

(86) PCT No.: PCT/JP2008/062314

§ 371 (c)(1),
(2), (4) Date: Jan. 22, 2010

(87) PCT Pub. No.: WO2009/013997

PCT Pub. Date: Jan. 29, 2009

(65) Prior Publication Data

US 2010/0147110 A1 Jun. 17, 2010

(30) Foreign Application Priority Data

Jul. 23, 2007 (JP) ..... 2007-190737

(51) Int. Cl.

| | |
|---|---|
| ***B22F 9/22*** | (2006.01) |
| ***B22F 9/28*** | (2006.01) |
| ***B22F 9/12*** | (2006.01) |

(52) U.S. Cl.

CPC ... *B22F 9/28* (2013.01); *B22F 9/12* (2013.01); *B22F 2998/00* (2013.01); *B22F 2999/00* (2013.01)

USPC ..... 75/367; 75/369

(58) Field of Classification Search

None

See application file for complete search history.

(56) References Cited

U.S. PATENT DOCUMENTS 3,068,089 A 12/1962 Antonsen et al.
6,001,148 A * 12/1999 Okamoto et al. ..... 75/10.15

(Continued)

FOREIGN PATENT DOCUMENTS

EP 1 839 783 A1 10/2007
JP 02-054705 2/1990

(Continued)

OTHER PUBLICATIONS

Official Action and English translation in KR 10-2010-7001983 mailed Oct. 14, 2011.

(Continued)

*Primary Examiner* — George Wyszomierski
(74) *Attorney, Agent, or Firm* — Nixon & Vanderhye P.C.

(57) ABSTRACT

A method of producing ultra-fine metal particles of the present invention includes: blowing metal powders of raw materials into reducing flame formed by a burner 3 in a furnace 5, wherein the metal powders are melted in the flame and allowed to be in an evaporated state, to thereby obtain the spherical ultra-fine metal particles. In the present invention, the atmosphere in the furnace 5 is preferably prepared such that the $CO/CO_2$ ratio is within a range from 0.15 to 1.2. Also, a spiral flow-forming gas is preferably blown into the furnace 5, and the oxygen ratio of the burner 3 is preferably within a range from 0.4 to 0.8. As raw materials, a metal oxide and/or a metal hydroxide which contain the same metal as the metal powders may be used together with the metal powders.

9 Claims, 5 Drawing Sheets

(56) References Cited

U.S. PATENT DOCUMENTS

| | | | | |
|---|---|---|---|---|
| 6,805,724 | B2 * | 10/2004 | Shver | 75/10.4 |
| 7,981,190 | B2 * | 7/2011 | Nakamura et al. | 75/346 |
| 8,012,235 | B2 * | 9/2011 | Takashima et al. | 75/346 |
| 8,062,406 | B2 * | 11/2011 | Igarashi et al. | 75/338 |
| 2007/0084308 | A1 * | 4/2007 | Nakamura et al. | 75/346 |
| 2008/0145657 | A1 | 6/2008 | Igarashi et al. | |
| 2011/0256250 | A1 | 10/2011 | Igarashi et al. | |

FOREIGN PATENT DOCUMENTS

| | | | |
|---|---|---|---|
| JP | 2002-241812 | | 8/2002 |
| JP | 2006-102737 | | 4/2006 |
| KR | 10-2007-0067794 | | 6/2007 |
| TW | 200631702 | A | 9/2006 |
| WO | 2006/068231 | | 6/2006 |
| WO | WO 2006/068231 | A1 | 6/2006 |
| WO | WO 2006/068231 | A1 | 6/2009 |

OTHER PUBLICATIONS

International Search Report For PCT/JP2008/062314, mailed Oct. 7, 2008.

Taiwanese Office Action and English translation in TW 097126023 mailed Feb. 8, 2012.

EP Search Report in EP 08 79 0951 dated Jul. 25, 2012.

* cited by examiner

SCALE: 50,000 TIMES

METHOD OF PRODUCING ULTRA-FINE METAL PARTICLES

This application is the U.S. national phase of International Application No. PCT/JP2008/062314, filed 8 Jul. 2008, which designated the U.S. and claims priority to Japanese application no. 2007-190737, filed 23 Jul. 2007, the entire contents of each of which are hereby incorporated by reference.

TECHNICAL FIELD

The present invention relates to a method of producing ultra-fine metal particles, which is a method in which metal powders that are used as raw materials are blown into reducing flame formed by a burner, and are melted and allowed to be in an evaporated state, to thereby obtain the spherical ultra-fine metal particles with a smaller particle size than those of the metal powders of the raw materials.

Priority is claimed on Japanese Patent Application No. 2007-190737, filed Jul. 23, 2007, the content of which is incorporated herein by reference.

BACKGROUND ART

In recent years, the use of ultra-fine metal particles has been major in the production of electronic parts. For example, electrodes of a laminated ceramic condenser are produced by applying and calcining a paste containing ultra-fine Ni particles with an average particle size within a range from 200 to 400 nm.

A lot of production methods of these kinds of ultra-fine metal particles have ever been proposed, and the production method that uses elemental metal as a raw material is disclosed in Japanese Patent Application, First Publication No. 2002-241812.

In this production method, arc discharge is excited in an atmosphere that contains hydrogen, to thereby form the high-temperature arc. In the formed high-temperature arc, a metal material of a raw material is disposed to be melted and evaporated, and then is cooled to thereby obtain ultra-fine metal particles.

Because this production method uses arc discharge, there is the problem that an energy cost increases.

Also, there is the method in which plasma is formed to melt and evaporate a metal material, to thereby produce ultra-fine metal particles. However, there is the problem that an energy cost increases.

Meanwhile, the method that uses a burner is proposed from the point of view of limiting an energy cost. For example, Japanese Unexamined Patent Application, First Publication No. Hei 2-54705 discloses the production method in which air, a fuel such as propane, and a combustion-assisting gas such as oxygen are provided to a burner to form a reducing flame, and a metal compound solution is blown into the reducing flame, to thereby obtain ultra-fine metal particles.

In this production method, the highest temperature of a reducing flame formed by a burner is within a range of 2,700° C. to 2,800° C. (the theoretical flame temperature), and therefore, the metal compound that can be reduced at the aforementioned temperature or lower is used as a raw material.

This is because it has been previously considered that the aforementioned temperature range is not high enough to melt and evaporate elemental metal and it is virtually impossible to melt and evaporate metal powders.

Herein, the theoretical flame temperature refers to the temperature that is obtained using enthalpy balance and element balance when a fuel and a combustion-assisting gas are combusted at an arbitrary ratio in an adiabatic state. The theoretical flame temperature is also referred to as the adiabatic equilibrium flame temperature.

Accordingly, there is not known the method of producing ultra-fine metal particles by using a burner and an elemental metal as a raw material.

[Patent Document 1]

Japanese Unexamined Patent Application, First Publication No. 2002-24812

[Patent Document 2]

Japanese Unexamined Patent Application, First Publication No. Hei 2-54705

DISCLOSURE OF INVENTION

Problems to be Solved by the Invention

An object of the present invention is to produce ultra-fine metal particles by using an elemental metal as a raw material and a burner method whose energy cost is inexpensive.

Means to Solve the Problems

In order to achieve the aforementioned objects, the present invention is a method of producing ultra-fine metal particles which includes blowing metal powders of raw materials into reducing flame formed by a burner in a furnace, wherein the metal powders are melted in the flame and allowed to be in an evaporated state, to thereby obtain the spherical ultra-fine metal particles.

In the present invention, the ultra-fine metal particles refer to the metal powders with an average particle size of about 1 μm or less.

In the present invention, a metal compound that contains the same metal as the metal powders may be used together with the metal powders as the raw materials.

Also in the present invention, it is preferable that a spiral flow be formed in the furnace.

Also, it is preferable that the atmosphere in the furnace is prepared such that the $CO/CO_2$ ratio of a combustion exhaust gas be within a range from 0.15 to 1.2.

Effect of the Invention

According to the present invention, ultra-fine metal particles can be produced by preparing a reducing flame and using an elemental metal in a burner method that has been previously considered not to be able to produce ultra-fine metal particles. In addition, it is possible to obtain the ultra-fine metal particles with a spherical shape and a smaller particle size than those of the metal powders of the raw materials. For example, it is possible to produce the spherical ultra-fine metal particles with a particle size of 200 nm or less which is about one tenth of the average particle size of the metal powders of the raw materials.

Therefore, the production cost of the present invention can be less than that of a conventional production method that uses arc or plasma.

DESCRIPTION OF THE REFERENCE SYMBOLS

1 represents a fuel supplier; 2 represents a feeder; 3 represents a burner; 4 represents a primary/secondary oxygen supplier; 5 represents a furnace; 6 represents a cooling gas supplier; and 7 represents a powder collector.

BEST MODE FOR CARRYING OUT THE INVENTION

Figure 1:
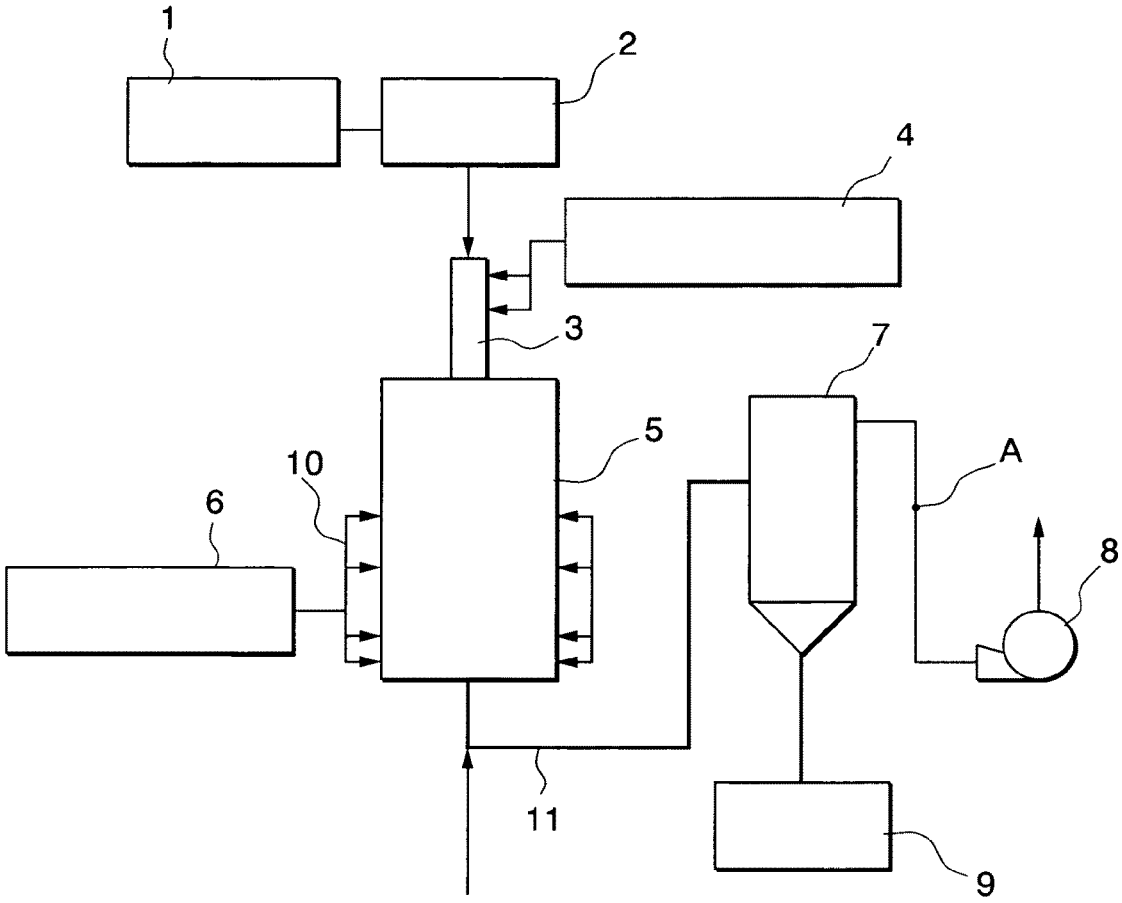
FIG. 1 is a schematic diagram representing a production apparatus that is used in the present invention.

FIG. 1 represents an example of the production apparatus that is used in the present invention.

The fuel gas such as LPG, LNG, and a hydrogen gas, which has been flowed out from the fuel supplier 1, is supplied to the feeder 2. The metal powders of raw materials are separately supplied to the feeder 2, and are flowed into the burner 3 by using the fuel gas as the carrier gas.

Examples of the metal powders that can be raw materials include the powders of metal such as nickel, cobalt, copper, silver, or iron, whose average particle size is within a range from 5 to 20 μm.

Figure 2:
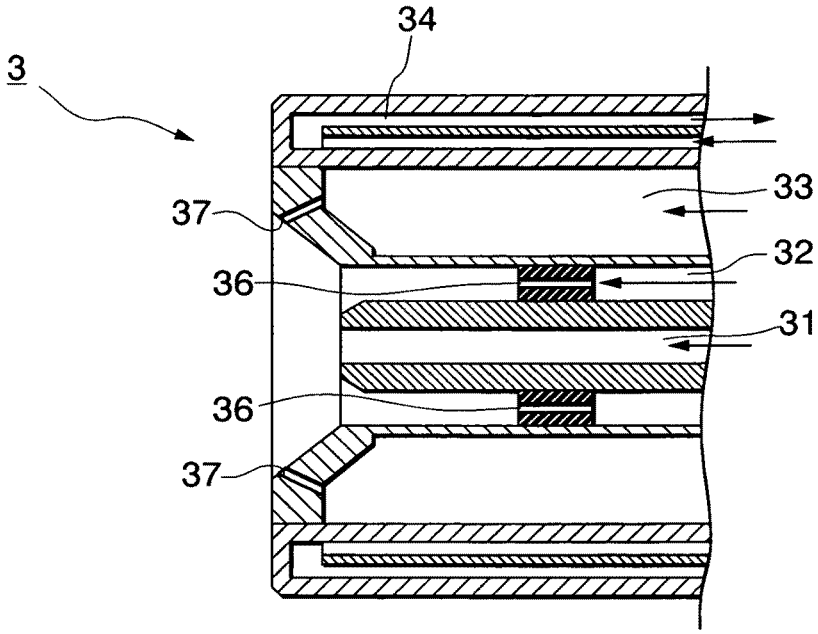
FIG. 2 is a schematic cross-sectional diagram representing a burner that is used in the present invention.
Figure 3:
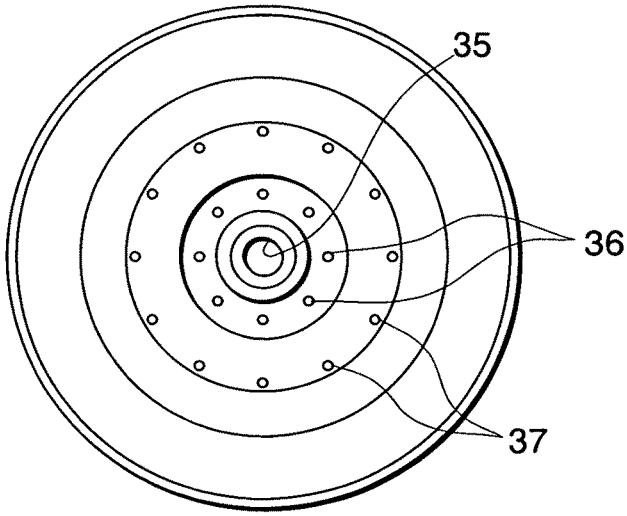
FIG. 3 is a schematic front view representing a burner that is used in the present invention.

FIG. 2 and FIG. 3 represent the main part of the aforementioned burner 3. In the burner 3 of this example, as shown in FIG. 2, the raw material powder supply path 31 is formed at the center, and the primary oxygen supply path 32 is formed outside the raw material powder supply path 31, and the secondary oxygen supply path 33 is coaxially formed outside the primary oxygen supply path 32. In addition, the water-cooling jacket 34 is formed outside the secondary oxygen supply path 34 so as to water-cool the burner 3 itself.

Moreover, in the front-end parts of these paths, as shown in FIG. 3, the one circular main opening section 35 is formed for the raw material powder supply path 31, a plurality of the circular small opening sections 36, 36" is formed and equally arranged in a circle for the primary oxygen supply paths 32, and a plurality of the circular sub-opening sections 37, 37" is formed and equally arranged in a circle for the secondary oxygen supply paths 33. The sub-opening sections 37, 37" are tilted at 5° to 45° so as to direct their central axes toward the central axis of the burner 3.

To the raw material supply path 31 of the burner 3, the metal powers and the fuel gas are flowed from the aforementioned feeder 2. To the primary oxygen supply path 32 and the secondary oxygen supply path 33, a combustion-assisting gas (an oxidant) such as oxygen or an oxygen-enriched air is flowed from the primary/secondary oxygen supplier 4 while adjusting the respective flow rates thereto.

The burner 3 is disposed at the top part of the furnace 5 such that the front end part of the burner 3 heads downward. In this example, the water-cooled furnace is used as the furnace 5, and cooling water is flowed within the water-cooling jacket that is outside the main body of the furnace, to thereby cool the combustion gas therein and to shield the internal atmosphere from the external atmosphere.

Moreover, the furnace can be comprised of a fire-resistive wall. In this case, the cooling gas such as nitrogen or argon is blown into the furnace from the cooling gas supplier that is not illustrated, to thereby cool the combustion gas therein. In addition, the furnace can be comprised of the combination of a water-cooling wall and a fire-resistive wall.

Moreover, the gas such as nitrogen or argon is blown from the spiral flow-forming gas supplier 6 through the pipe 10 into the furnace 5 so as to form a spiral flow in the furnace 5.

In other words, a plurality of gas-blowing holes is formed on the peripheral wall of the furnace 5 in the internal circumferential direction and the height direction, and the gas-blowing directions of these gas-blowing holes are along with the internal circumference of the furnace 5. Therefore, when the gas such as nitrogen or argon is blown from the spiral flow-forming gas supplier 6 into the furnace 5, a spiral flow is formed in the furnace 5.

The formation method of a spiral flow in the furnace 5 is not limited to the aforementioned method. A spiral flow can be formed by the adjustment of the mounting position of the burner 3 on the furnace 5 and the direction of the nozzle of the burner 3, and the shape and structure of the opening section of the nozzle of the burner 3.

The gas that is discharged from the bottom part of the furnace 5 contains the ultra-fine metal particles of the product. This gas is flowed through the pipe 11 into the powder collector 7 such as a bag filter, a cyclone, or a wet type dust collector, in which the ultra-fine metal particles within the gas are trapped and collected. Then, the gas is discharged outside by the blower 8.

In addition, outside air is supplied to the pipe 11, through which the gas discharged from the furnace 5 flows, to thereby cool the exhaust gas.

In the production of ultra-fine metal particles by the aforementioned production apparatus, the raw material metal powders and the fuel are flowed from the feeder 2 to the raw material supply path 31, and the combustion-assisting gas is flowed from the primary/secondary oxygen supplier 4 to the primary oxygen supply path 32 and the secondary oxygen supply path 33, to thereby cause the combustion.

During this combustion, the amount of the oxygen required for completely burning the fuel (hereinafter referred to as the oxygen ratio; the oxygen amount enough to completely burn the fuel is defined as 1) is adjusted within a range from 0.4 to 1.2, preferably from 0.6 to 1.2, to thereby form the reducing flame in which carbon monoxide or hydrogen remains. In this case, it is not necessary to adjust the oxygen amount lower than the oxygen amount required for complete combustion, and the oxygen amount may be excess.

At the same time, the supply amounts of the fuel and the combustion-assisting gas are adjusted to control the volume ratio $CO/CO_2$ of carbon monoxide and carbon dioxide within the gas discharged from the furnace 5 within a rage from 0.15 to 1.2. When the volume ratio $CO/CO_2$ is below 0.15, the produced ultra-fine particles are oxidized. When the volume ratio $CO/CO_2$ is over 1.2, a lot of soot occurs within the combustion gas, and the ultra-fine metal particles are contaminated with this soot.

The measurement of the volume ratio $CO/CO_2$ of carbon monoxide and carbon dioxide within the discharged gas is performed at the measurement point A in FIG. 1. In addition, the measurement is constantly performed by the measurement device such as Fourier Transform Infrared Spectrometer, and the flow ratio of the fuel and the combustion-assisting gas is adjusted on the basis of this measurement result.

Furthermore, the gas inside the furnace is cooled by flowing cooling water in the furnace 5, to thereby suppress the produced ultra-fine metal particles from colliding with one another and being fused and upsized. For the furnace comprised of a fire-resistive wall, the cooling gas such as nitrogen or argon is blown into the furnace from the cooling gas supplier that is not illustrated, to thereby rapidly cool the inside gas. When the temperature of the cooling gas introduction section is 500° C. or less, air can be used instead of nitrogen or argon as a cooling gas.

At the same time, the spiral flow-forming gas such as nitrogen or argon is blown from the spiral flow-forming gas supplier 6 into the furnace 5 so that the spiral flow of the combustion gas is formed in the furnace 5. Because of this spiral flow, the shape of the produced particles becomes a spherical shape, and the produced ultra-fine particles are unlikely to collide with each other and be upsized. In addition, the produced ultra-fine particles are prevented from being attached to the internal wall of the furnace 5.

The following Table 1 shows the representative production conditions in the case where the nickel metal with a particle size of 5 to 20 μm is used as a raw material.

TABLE 1

| | |
|---|---|
| Supply amount of nickel metal | 1.0 to 9.0 kg/h |
| Flow rate of LNG | 5 to 30 $Nm^3/h$ |
| Flow rat of oxygen | 6 to 72 $Nm^3/h$ |
| Blow rate of spiral flow-forming nitrogen | 0 to 250 $Nm^3/h$ |
| Primary/secondary oxygen ratio | 1/9 to 9/1 |
| Oxygen ratio | 0.6 to 1.2 (-) |

According to the production method of fine metal particles, it is possible to produce the spherical ultra-fine metal particles with a particle size of 50 to 200 nm and to obtain the ultra-fine particles with a particle size that is within a range from one tenth to one hundredth of the average particle size of the metal powders of the raw materials. In addition, when the combustion gas is rapidly cooled in the vicinity of the outlet for the exhaust gas of the burner, it is possible to obtain the fine particles with the average particle size of about 1 to 10 nm.

This means that the raw material metal powders are melted within the reducing flame formed by the burner 3, evaporated to be in an atomic state, and grown up to the ultra-fine particles. In addition, this shows that it is possible to produce metal nanoparticles by using a burner method that has been previously considered not to be able to produce those.

Herein, the cooling temperature is not particularly limited as long as it is the temperature at which the raw material metal is solidified (not more than a melting point). For example, the cooling temperature may be lower than the melting point of the raw material by about 100° C.

Furthermore, when the ultra-fine metal particles collected by the powder collector 7 are classified by a classification apparatus, it is possible to obtain the ultra-fine metal particles with the desired particle size distribution as the product. The residues of the ultra-fine metal particles that was subjected to the classification (which are mainly ultra-fine metal particles with a large particle size) can be collected and reused as the raw material metal powders.

In the present invention, the metal powders of raw materials and the metal compound that contains the same metal as the metal constituting the metal powders can be combined and used as raw materials, and the ultra-fine metal particles can be produced by the same production method.

For example, a metal oxide and a metal hydroxide can be used as the metal compound. In specific, the powders of the mixture of copper, and copper oxide and/or copper hydroxide can be used as the raw materials.

Technically, a metal chloride can be used as the metal compound, but is not preferred because chlorine and hydrogen chloride occur.

When the metal compound is used, the ratio of the metal compound to the whole raw materials can be arbitrarily adjusted.

In the present invention, the structure of the burner is not limited to the structure illustrated in FIG. 2 and FIG. 3, and it is possible to appropriately arrange the shapes of ejection parts for the raw material metal powders, the fuel, and the combustion-assisting gas.

Moreover, the raw material metal powders may not be introduced into burner 3 together with the fuel gas, but may be blown directly through the portion other than the burner into the reducing flame formed by the burner. Furthermore, the raw material metal powders may be flowed to the burner with a gas other than the fuel, such as air. A hydrocarbon-based fuel oil other than gas can be used as the fuel. In this case, the raw material metal powders are directly blown through the portion other than the burner into the reducing flame formed by the burner.

EXAMPLES

Hereinafter, specific examples are described. The present invention is not limited to these specific examples.

The ultra-fine nickel particles were produced by using the production apparatus illustrated in FIG. 1, FIG. 2, and FIG. 3, and nickel metal powders with an average size of 5 to 20 μm were used as the raw material metal powders.

The pure oxygen was used as the combustion-assisting gas for the burner 3, and the combustion was caused while adjusting the oxygen ratio within a ratio from 0.4 to 1.2. LNG was used as the fuel. The furnace 5 had the whole water-cooling structure which had both of the function of shielding the internal atmosphere from the external atmosphere and the function of cooling the particles. In addition, the port for suctioning air was provided to the duct that connects the outlet of the furnace to the bag filter, in which the exhaust gas was diluted and cooled. The particles were collected by the bag filter, and the exhaust gas was discharged to the outside atmosphere after the combustible component in the exhaust gas was combusted. The nitrogen was blown from the spiral flow-forming gas supplier 6 into the furnace 5, to thereby form the spiral flow in the furnace 5. The combustion conditions were according to the conditions shown in Table 1.

Figure 4:
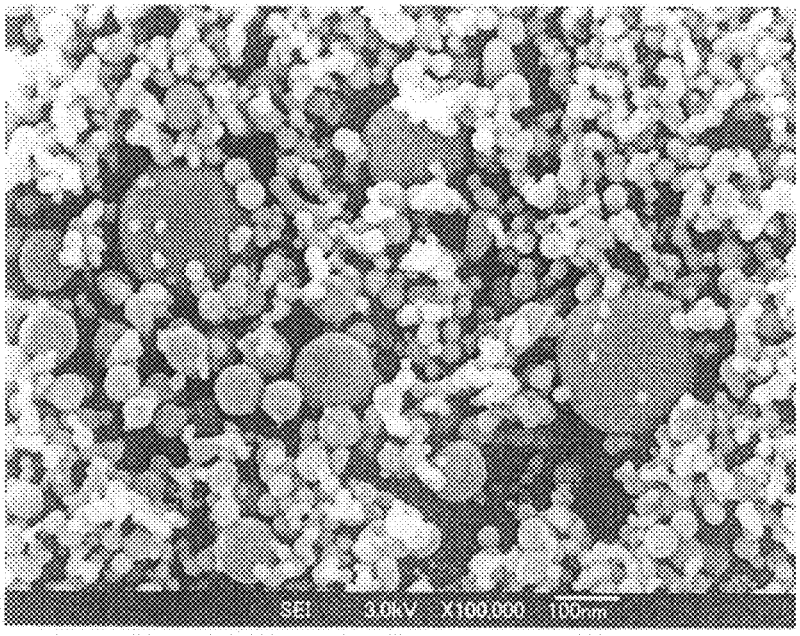
FIG. 4 is the micrograph showing the fine nickel particles produced in Examples.

FIG. 4 shows the image that was obtained by observing the collected ultra-fine nickel particles with the scanning electron microscope (SEM). The particles on this image were collected in the vicinity of the nozzle of the burner in the furnace, and the many nanoparticles existed around the particles with a particle size of about 100 nm. It can be confirmed by this result that the nickel metal powders were evaporated. These nanoparticles are grown up in the furnace, rapidly cooled to form the particles with a certain particle size, and collected.

Figure 5:
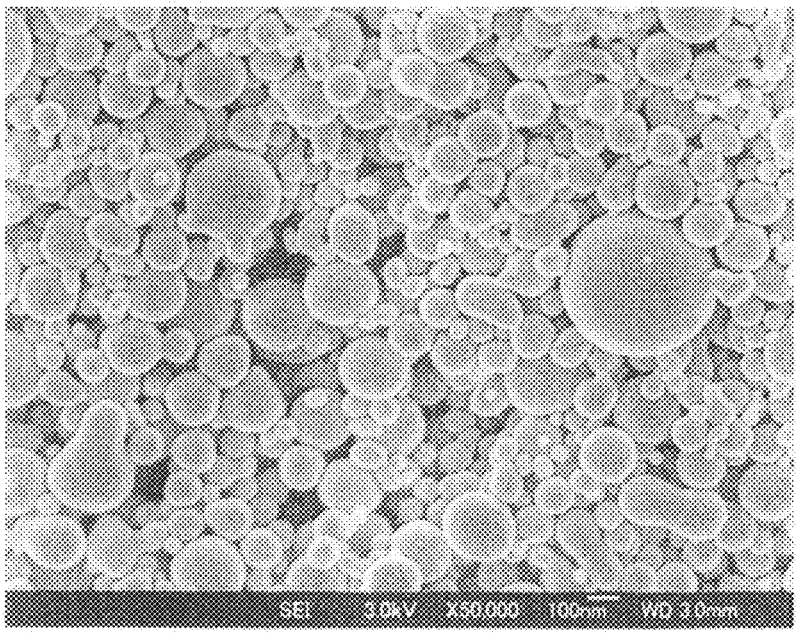
FIG. 5 is the micrograph showing the fine nickel particles produced in Examples.

FIG. 5 shows the image that was obtained by observing the ultra-fine nickel particles collected by the bag filter with the scanning electron microscope (SEM). It was found from the measurement result of the specific surface area that the observed particles were the ultra-fine particles with the average particle size of 140 nm. Also, it was confirmed from the measurement result that the particles had the oxygen concentration of 1.15% and were the ultra-fine nickel metal particles of which the surfaces were covered with the oxidized film with the thickness of several nanometer. In addition, the yield of the ultra-fine nickel particles was 80% compared with the supply amount of the raw materials. In this example, the $CO/CO_2$ ratio of the exhaust gas was adjusted within a range from 0.16 to 0.45.

Figure 6:
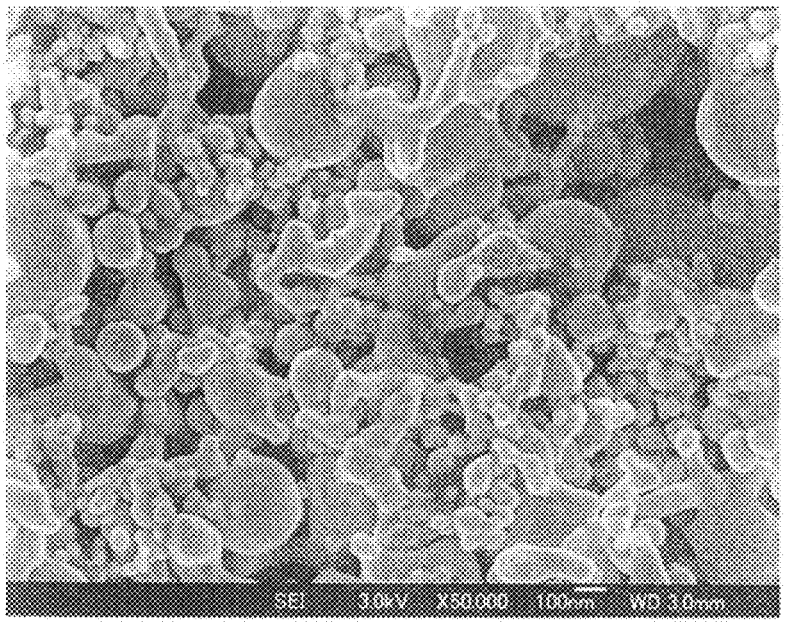
FIG. 6 is the micrograph showing the fine nickel particles produced in Examples.

FIG. 6 shows the image that was obtained by observing the particles with the scanning electron microscope (SEM), which were produced without blowing the spiral flow-forming nitrogen into the furnace and were collected by the bag filter. In this example, a lot of the particles are fused with each other so as to form the joined particles, and the particles were not in a spherical shape. Therefore, it can be understood that the formation of the spiral flow in the furnace is the effective method to reduce the joined particles and to produce the ultra-fine nickel metal particles in a good spherical shape. In addition, the yield was 30% in this example, and it was found that the yield of the ultra-fine particles largely decreased when the spiral flow was not formed.

Figure 7:
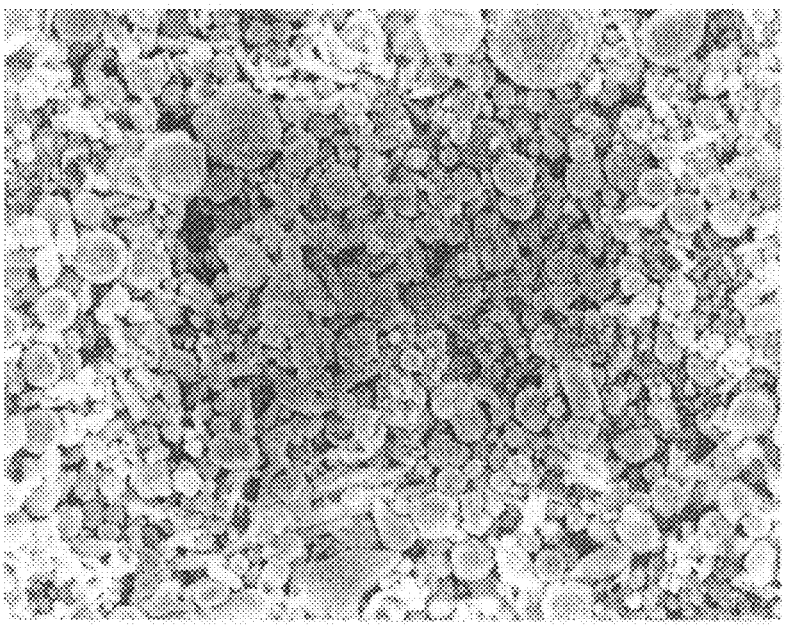
FIG. 7 is the micrograph showing the fine nickel particles produced in Examples.

FIG. 7 shows the image that was obtained by observing the particles with the scanning electron microscope (SEM), which were produced while adjusting the $CO/CO_2$ ratio of the exhaust gas within a range from 0.1 to 0.15 and were collected by the bag filter. The many fine particles in a quadrangular shape that was different from the particle shape shown in FIG. 5 were observed on this image. It was confirmed from the measurement result that the particles had the oxygen concentration of 8% and contained a lot of nickel oxides. It was found that the produced ultra-fine particles were oxidized when the $CO/CO_2$ ratio was below 0.15.

Figure 8:
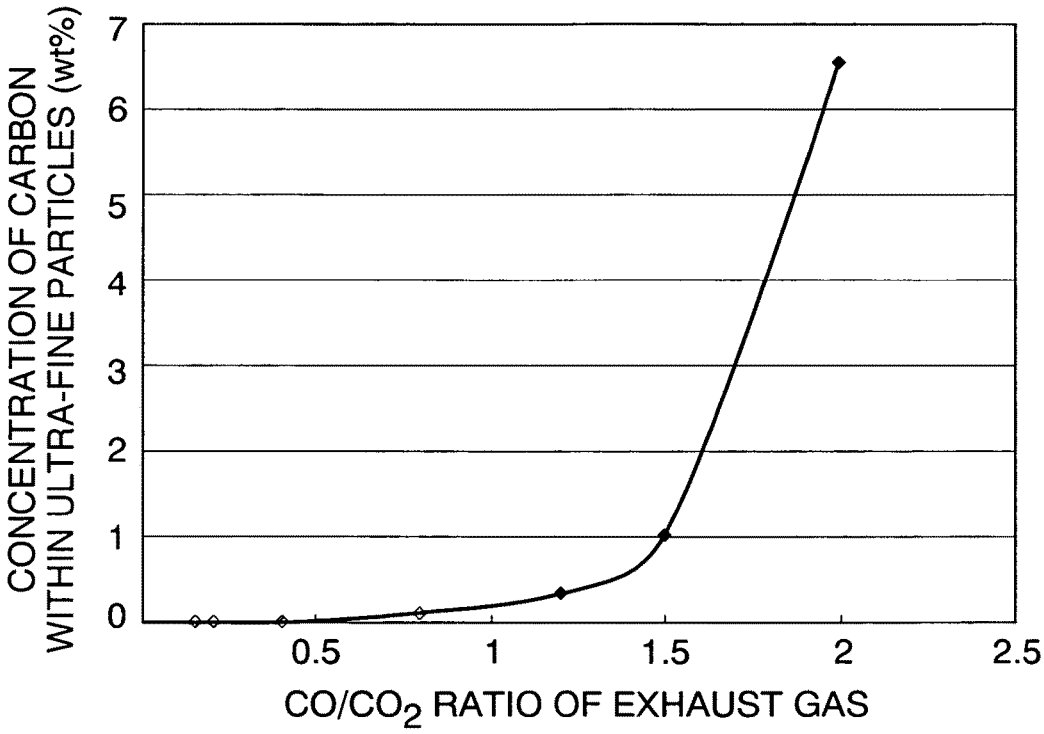
FIG. 8 is the graph showing the relationship between the $CO/CO_2$ ratio of an exhaust gas and the concentration of the carbon within the produced ultra-fine particles in Examples.

FIG. 8 is the graph showing the relationship between the $CO/CO_2$ ratio and the concentration of the carbon within the produced ultra-fine particles. When the $CO/CO_2$ ratio exceeds 1.2, the production amount of the soot drastically increases, indicating that the soot is mixed in the ultra-fine metal particles as an impurity.

From the point of view described above, it can be found that the adjustment of the $CO/CO_2$ ratio of the exhaust gas within a range from 0.15 to 1.2 is preferred to prevent the oxidization of the ultra-fine particles and to suppress the contamination due to the soot.

In the aforementioned examples, nickel was used. However, it was confirmed that the oxidization of the ultra-fine particles and the contamination due to the soot could be prevented by adjusting the $CO/CO_2$ ratio of the combustion exhaust gas within a range from 0.15 to 1.2 even when the metal powders of cobalt, copper, and silver were used as the raw materials.

The invention claimed is:

1. A method of producing ultra-fine metal particles comprising:

blowing metal powders of raw materials into reducing flame formed by a burner with a fuel gas and a combustion-assisting gas in a furnace, wherein the metal powders are melted in the flame so as to be in an evaporated state and then cooled, thereby obtaining the ultra-fine metal particles, and the combustion-assisting gas is an oxidant, the metal powders are flown from an opening section at the center of the burner into the burner in approximately the same direction as the combustion-assisting gas, and blown from the burner into the reducing flame.

2. A method of producing ultra-fine metal particles according to claim 1, wherein a metal compound that contains the same metals as the metal powders is used together with the metal powders as the raw materials.

3. A method of producing ultra-fine metal particles according to claim 1, wherein a spiral flow is formed in the furnace.

4. A method of producing ultra-fine metal particles according to claim 1, wherein the atmosphere in the furnace is prepared such that the $CO/CO_2$ ratio in a combustion exhaust gas is within a range from 0.15 to 1.2.

5. A method of producing ultra-fine metal particles according to claim 2, wherein the atmosphere in the furnace is prepared such that the $CO/CO_2$ ratio in a combustion exhaust gas is within a range from 0.15 to 1.2.

6. A method of producing ultra-fine metal particles according to claim 3, wherein the atmosphere in the furnace is prepared such that the $CO/CO_2$ ratio in a combustion exhaust gas is within a range from 0.15 to 1.2.

7. A method of producing ultra-fine metal particles according to claim 1, wherein the oxidant is oxygen or an oxygen enriched air.

8. A method of producing ultra-fine metal particles according to claim 1, wherein the burner burns the fuel gas with the combustion-assisting gas at an oxygen rate adjusted within a range from 0.4 to 1.2, to thereby form the reducing flame in which carbon monoxide or hydrogen remains.

9. A method of producing ultra-fine metal particles according to claim 1, wherein the powders are nickel metal powders.

* * * * *